US005581814A

United States Patent [19]

Ettinger

[11] Patent Number: 5,581,814

[45] Date of Patent: Dec. 10, 1996

[54] FUR HAT

[76] Inventor: Solomon Ettinger, 1654 46th St., Brooklyn, N.Y. 11201

[21] Appl. No.: 574,325

[22] Filed: Dec. 18, 1995

[51] Int. Cl.[6] ..... A42B 1/00

[52] U.S. Cl. ..... 2/200.1; 2/65; 2/171

[58] Field of Search ..... 2/65, 171, 200.1, 2/66; 112/80.02; 132/53, 54; 428/16, 92

[56] References Cited

U.S. PATENT DOCUMENTS 741,327 10/1903 Gordon ..... 2/200.1
3,688,779 9/1972 Greco ..... 132/53

FOREIGN PATENT DOCUMENTS 1377550 3/1965 France ..... 2/200.1
2098548 11/1982 United Kingdom ..... 2/65

*Primary Examiner*—Diana Biefeld
*Attorney, Agent, or Firm*—Myron Amer, PC

[57] ABSTRACT

A hat having its cylindrical body adorned by synthetic fur bristles put up in pelts, and rendered waterproofed by rooting the pelts in the cylindrical body so they are in a horizontal orientation in overlapping relation to each other and in encircling relation about the cylindrical body, thus serving both as an appearance-enhancing adornment of the cylindrical body and as a waterproofing barrier against rain seepage through the rooting connections of the pelts to the cylindrical hat body.

1 Claim, 3 Drawing Sheets

FUR HAT

The present invention relates generally to improvements for a popular fur hat, the improvements more particularly resulting in the effective waterproofing of the hat.

EXAMPLES OF THE PRIOR ART

The use of fur for hats, because of the warmth of this hat construction material, is already well known, as exemplified by U.S. Pat. No. 260,332 issued to Sali Simonson for "Band Cap" on Jun. 27, 1882. Aside, however, from using the fur as effective protection during cold weather, for not only the user's head but also the ears and back of the head of the wearer, the Simonson, and all other known fur hats, is not waterproof to provide this further degree of protection for the wearer.

Known hats also to be noted, and more particularly (1) a tubular hat configuration and (2) an external three-ply hat covering, are exemplified respectively by U.S. Pat. No. 5,303,427 issued to Dina Fishbaine for "Combination Hat and Bag" on Apr. 19, 1994, and U.S. Pat. No. 5,309,574 issued to Jeffrey B. Balaban et al. for "Weather-Adaptable Ski Hat" on May 10, 1994.

Underlying the present invention is the recognition that the attributes (1) and (2) noted in the '427 and '574 hats can be used effectively and advantageously in enhancing the utility of the '332 hat to include waterproofing.

Broadly, it is an object of the present invention to provide a fur hat overcoming the foregoing non-waterproofed, and other shortcomings, of the prior art.

More particularly, it is an object to adorn the tubular body of the within inventive hat with fur pelts of waterproof construction material in a manner which is both appearance-enhancing and also serves as a waterproofing barrier against rain seepage to the interior of the hat, all as will be better understood as the description proceeds.

The description of the invention which follows, together with the accompanying drawings, should not be construed as limiting the invention to the example shown and described, because those skilled in the art to which this invention appertains will be able to devise other forms thereof within the ambit of the appended claims.

Figure 5:
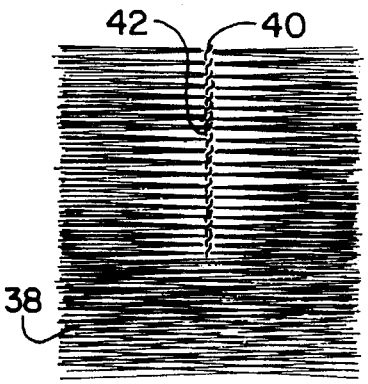
Figure 8:
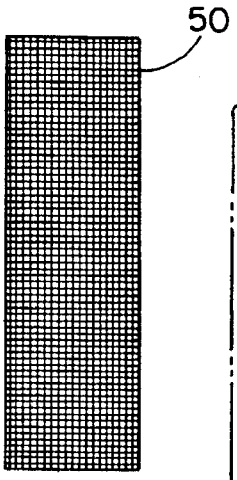
Figure 9:
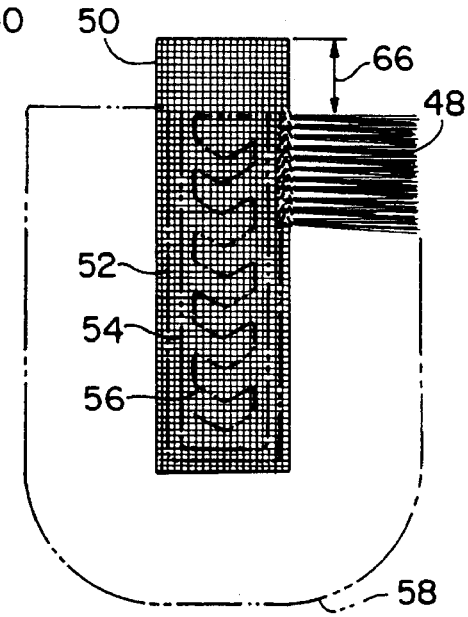
Figure 6:
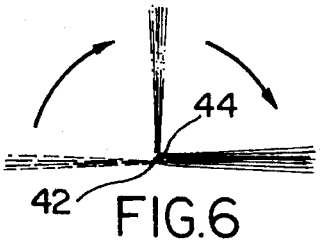
Figure 7:
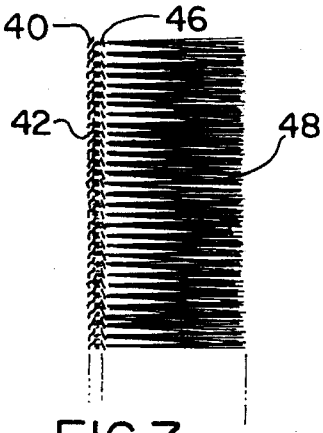
Figure 10:
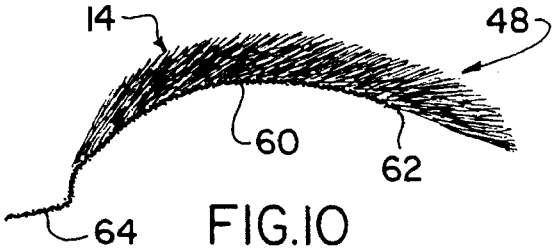
Figure 11:
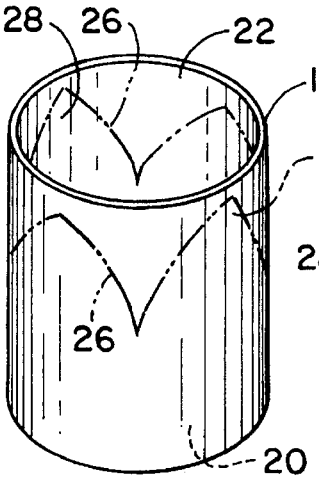
Figure 12:
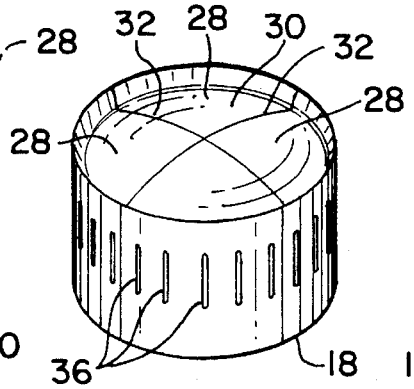
Figure 13:
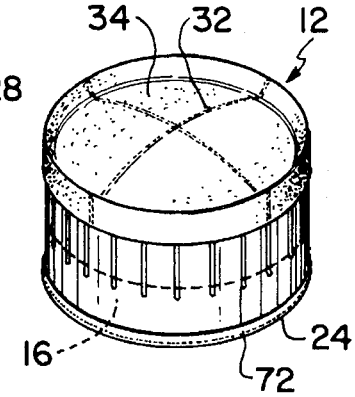

FIGS. 5–10 illustrate the preferred preparation of the synthetic fur pelts for use as an adornment on the hat, FIG. 5 being a plan view of initial steps of arrangement and sewing of the bristles, FIG. 6 being an end view projected from FIG. 5 showing a folding step, FIG. 7 being similar to FIG. 5 showing a subsequent sewing step, FIG. 8 being a plan view of a screen component to which the prepared bristles according to FIGS. 5–7 are attached incident to forming pelts, FIG. 9 is a view similar to FIG. 8 and showing the sewing attachment of the bristles of FIGS. 5–7 to the screen component of FIG. 8, and FIG. 10 is a side elevational view of a completed fur pelt; and FIGS. 11–13 are perspective views illustrating in sequence the preferred manner of constructing the shell or body of the hat to which the fur pelts of FIG. 10 are attached.

Figure 1:
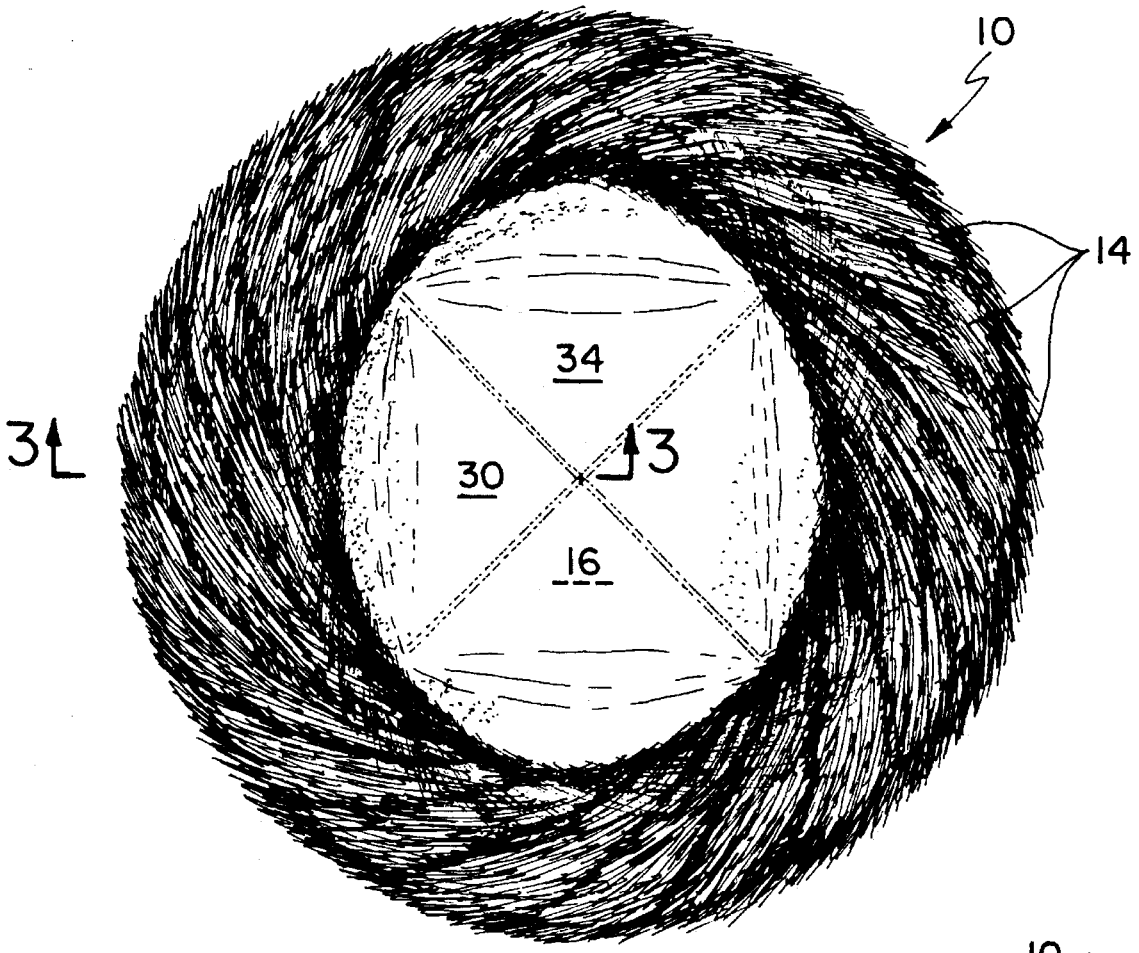
FIG. 1 is a plan view of a waterproofed fur hat according to the present invention.
Figure 2:
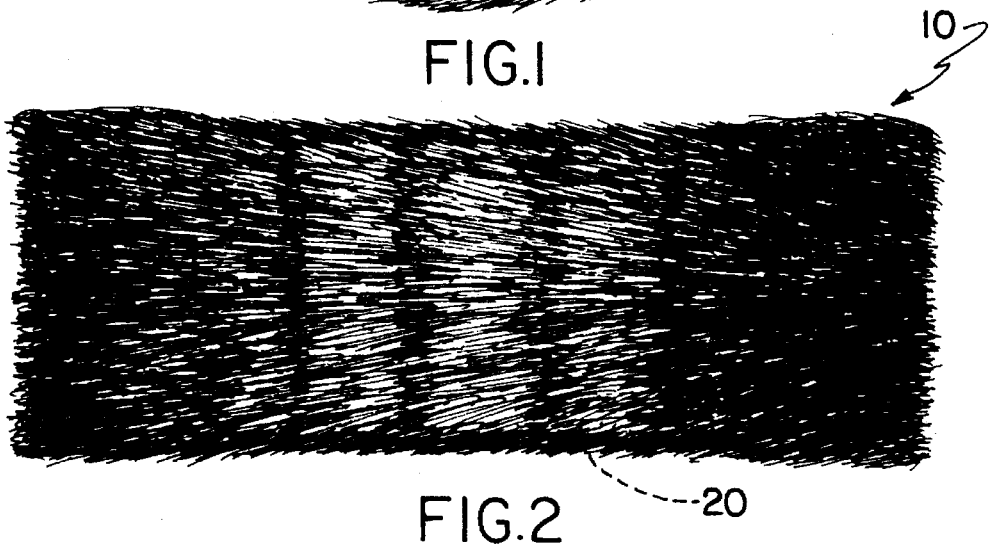
FIG. 2 is a front elevational view projected from FIG. 1.

By dictionary definition a "top hat" is "a tall black silk hat" or "high hat" and the within inventive hat is aptly characterized as a modified "high hat" in which the modifications consist of eliminating the brim and silk cloth, and adorning the exterior of the cylindrical body presenting the "high" appearance with fur. The specific utility of the resulting fur hat, designated 10 in FIGS. 1 and 2, is that it is waterproof, since underlying the present invention is the recognition that using to advantage the top hat-type cylindrical body 12 (FIG. 13) and the fur adornment of overlapping pelts 14 (FIGS. 3 and 4) that water seepage into the interior 16 of the hat 10 can be effectively minimized, all as will be better understood as the description proceeds.

Waterproofing improvements, according to the present invention, are facilitated by hat 10 having a cylindrical shell 18 of cardboard construction material with open ends 20 and 22 (FIGS. 11–13) of a selected diameter sized to receive a user's head in the bottom end opening 20 lined with a leather sweatband 24 and a closed top opening 22 resulting, in a known manner, by scoring along the phantom perspective lines 26 to delineate flaps 28 which in folded down relation cooperate to form the closure 30 held in place by adhesive at 32, and optionally enhanced in appearance by a velvet cloth 34 covering. As best shown in FIGS. 12, 13 is a circumferential array of lengths of spaced apart apertures, individually and collectively designated 36, which are essential structure for proper securement to the cylindrical shell 18 of the pelts 14, but which heretofore prevented embodying waterproofing to the hat 10.

To overcome the problem posed by the apertures 36 there is selected to be used for the pelts 14, bristles, individually and collectively designated 38, of water-repellant or non-absorbent plastic construction material, arranged initially in line, as best shown in FIG. 5, and then sewn, as at 40, to form along the seam 40 what may aptly be termed a spine 42 (FIG. 6), along which spine the work-in-process component is folded, as noted at 44, into two plies, and is again stitched at 46 along the spine edge 42, to form what may aptly be termed a fur strip 48 (FIG. 7).

Use is then made of a rectangular shaped metal screen 50 (FIG. 8) to which the fur strips 48 of FIG. 7 are sewn, adhesively attached, stapled or otherwise appropriately attached, to make the previously noted individual pelts 14. More particularly, and as may best be understood from FIG. 9, the preferred sequence of attachment is to attach a FIG. 7 fur strip 48 at location 52, a next FIG. 7 fur strip 48 at location 54, and a final FIG. 7 fur strip 48 along the zigzag or chevron location 56 (the fur strips 48 being omitted from FIG. 9 for simplicity) to provide a completed pelt construction with bristle free ends in a fanned-out expanse denoted by the reference line 58.

The free ends of the bristles 38 are then assembled appropriately incident to being formed into the pelt configuration of FIG. 10 resulting in what may aptly be termed an elongated bristle-supporting stem 60 having an opposite tip 62 and a stem base or root 64 provided by the length portion 66 of the screen 50 left free of fur strips 48.

Figure 3:
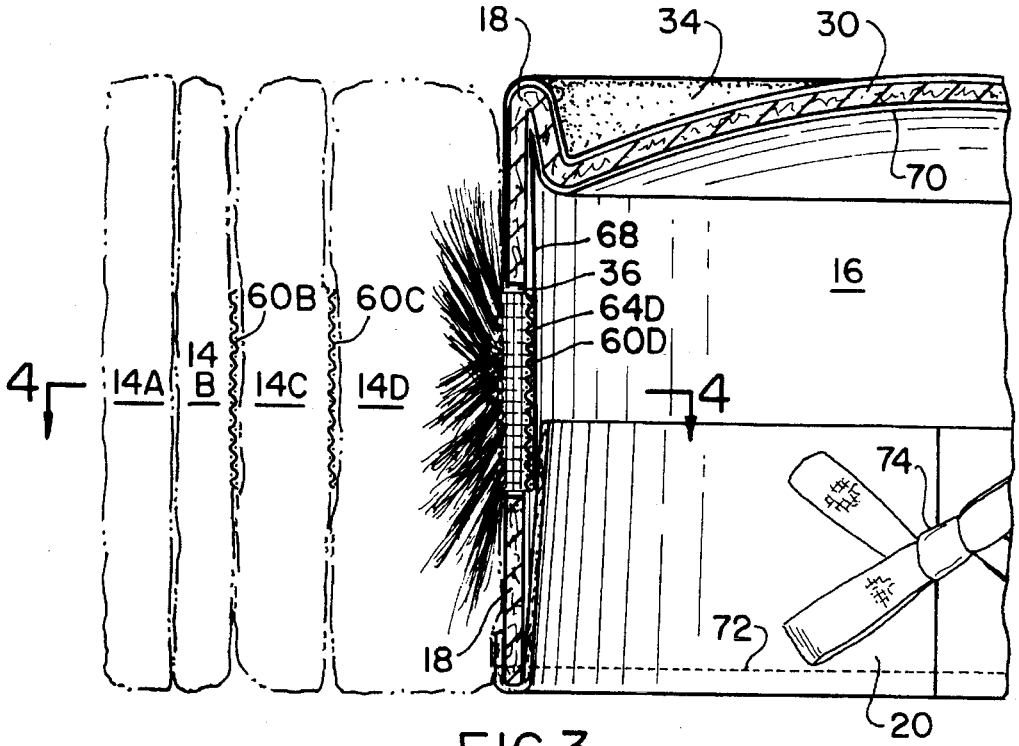
FIG. 3 is a cross sectional view taken along line 3—3 of FIG. 1 showing the overlapping relation of synthetic fur pelts used as the external adornment of the fur hat.
Figure 4:
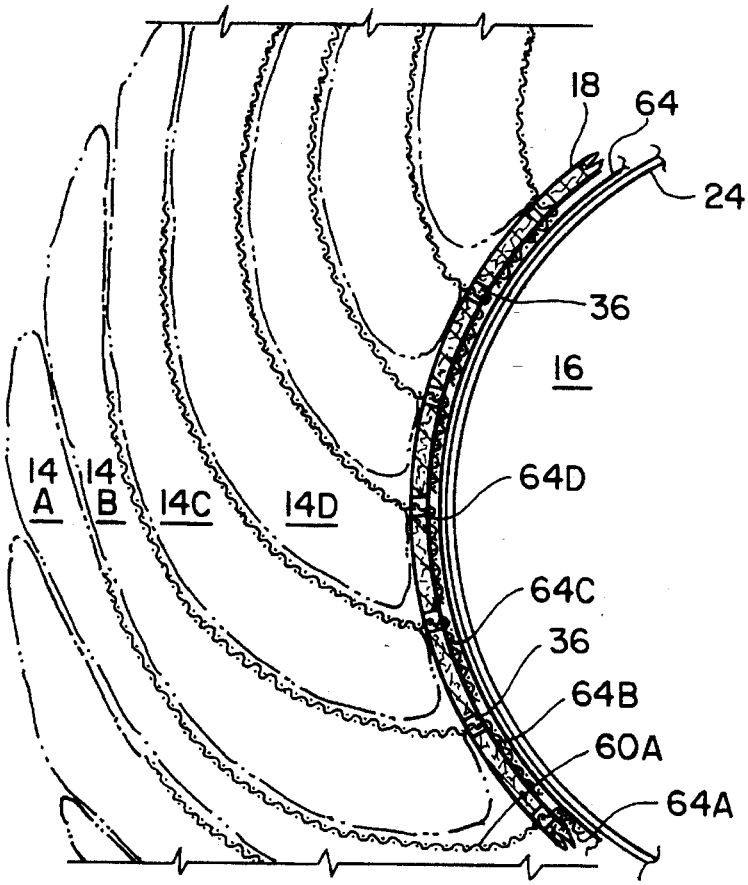
FIG. 4 is a cross sectional view similar to FIG. 3 as taken along line 4—4 of FIG. 3.

Referring now to FIGS. 3 and 4, the roots 64 of the pelts, more particularly designated 14A, 14B, 14C and 14D, are seated in a cooperating aperture 36 and suitably held in place by a folded interposed position between the shell 18 and a liner 68, optionally aided by adhesive, stapling, or the like, and this positions the pelts 14A-D in a horizontal orientation in overlapping relation to each other and in encircling relation about the cylindrical body or shell 18. As a result, it has been found in practice that the synthetic fur pelts 14 cooperate to provide an appearance-enhancing adornment to the hat 10 and also serve as a waterproofing barrier against rain seepage through the body apertures 36.

For completeness' sake it is noted that the hat top closure 30 is provided with a padded lining 70 glued in place in a final assembly step and that the sweatband 24 is stitched in place as along the seam 72. Optionally a flat bow 74 is displayed on the sweatband 24.

While the article of manufacture herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. Waterproofing improvements for a hat of a type having in covering relation thereover fur means as an external appearance-enhancing adornment, said waterproofing improvements comprising an opposite open ended cylindrical body of a selected diameter sized to receive a top of a user's head within one said end opening incident to said cylindrical body having an operative supported position in a vertical orientation on said user's head, a cover over said other said cylindrical body end opening, fur means of waterproof construction material consisting of plural pelt means each individual constituent of said pelt means being elongated in configuration characterized by a stem having fur-appearing bristle means supported lengthwise on and along said stem and a stem base without fur-appearing bristle means supported thereon extending from said stem, and said cylindrical body having a circumferential array of vertically oriented spaced-apart apertures for the attachment thereto of said pelt means, said pelt means having operative positions with said stem bases thereof oriented transversely of and projected into said vertically oriented apertures effective for positioning said fur-appearing bristle means in a horizontal orientation in overlapping relation to each other and in encircling relation about said cylindrical body, whereby said fur means serves both as an appearance-enhancing adornment of said cylindrical body and as a waterproofing barrier against rain seepage through said cylindrical body apertures.

* * * * *